United States Patent [19]

Astolfi

[11] Patent Number: 4,790,089

[45] Date of Patent: Dec. 13, 1988

[54] PICTURE FRAME

[75] Inventor: Pietro Astolfi, Bologna, Italy

[73] Assignee: Pico-Glass S.p.A., Italy

[21] Appl. No.: 925,365

[22] Filed: Oct. 30, 1986

[30] Foreign Application Priority Data

Oct. 31, 1985 [IT] Italy ..... 3587 A/85

[51] Int. Cl.[4] ..... G09F 1/12

[52] U.S. Cl. ..... 40/156; 40/152.1

[58] Field of Search ..... 40/152, 156, 157, 152.1

[56] References Cited

U.S. PATENT DOCUMENTS

| | | | |
|---|---|---|---|
| 3,798,815 | 3/1974 | Ward | 40/156 |
| 4,217,710 | 8/1980 | Becker | 40/156 |
| 4,235,030 | 11/1980 | Astolfi | 40/152 |
| 4,349,974 | 9/1982 | Rapayelian | 40/156 |
| 4,356,648 | 11/1982 | Beaulieu | 40/156 |

FOREIGN PATENT DOCUMENTS

| | | | |
|---|---|---|---|
| 2640642 | 3/1978 | Fed. Rep. of Germany | 40/152 |
| 3510907 | 10/1986 | Fed. Rep. of Germany | 40/152 |
| 7905153 | 1/1981 | Netherlands | 40/157 |
| 649455 | 1/1951 | United Kingdom | 40/152 |
| 1536121 | 12/1978 | United Kingdom | 40/156 |
| 2095990 | 10/1982 | United Kingdom | 40/152 |

*Primary Examiner*—Robert P. Swiatek
*Assistant Examiner*—Cary E. Stone
*Attorney, Agent, or Firm*—Darby & Darby

[57] ABSTRACT

The picture frame described herein is particularly sturdy and economic in as much as the framework (1) and support plane (2) on to which the image (3) is placed and the transparent plane (4) are held together by blocking elements (7) independently of the framework (1), and the framework (1) and all the other components are attached to one another by means of coupling elements (6) which by gripping onto the support plane (2) constitute the coupling elements for supporting the entire frame.

11 Claims, 2 Drawing Sheets

PICTURE FRAME

BACKGROUND OF THE INVENTION

1. Field of the Invention

The invention here described concerns a picture frame, comprising a polygonal frame which holds a rigid plane for supporting the image to be displayed and a transparent plane for protecting the image.

2. Description of the Prior Art

At the present time different types of frames for displaying images can be found on the market, which can be more or less divided into two groups.

The first group consists of the so-called frameless clip frames, where the image is placed between two planes having the same perimetral dimensions, one being a rigid plane for supporting the image, the other being transparent for protecting the image, attached to one another by means of special blocking elements. The whole assembly is then hung onto one or more nails fixed into a wall, thus the support plane acts as the load-bearing element for the whole assembly.

The second group, however, comprises the so-called traditional frames, in other words those which have a frame which has, on the side not on display, a ledge against which are lodged the rigid plane, the image and the transparent plane.

Coupling elements are then applied to the framework by which the frame can be hung on a wall with nails, so it is the framework itself which supports the whole assembly.

When, however, images or photographs of large dimensions have to be displayed, the transparent plane, which is almost indispensable and usually made of glass, together with the support indispensable and usually made of glass, together with the support is somewhat heavy and distorts the framework, which can result in breakages in addition to creating a rather unattractive appearance.

Objects and Summary of the Invention

The purpose of this invention is therefore to eliminate the problem mentioned above, and the invention, as defined by the claims, resolves the problem of supplying a traditional-type picture frame which is sturdy enough for displaying large size images because the coupling elements are applied to the plane supporting the image, which thus acts as a load-bearing element.

One of the advantages resulting out of this invention is the strength of the structure due to the fact that the weight of the entire frame, and in particular the transparent plane, is not concentrated in one or in a few points of the upper horizontal side of the framework, but is spread out all along it by means of the plane supporting the image and onto which the coupling components are applied.

Another advantage of this invention is the practicality obtained by cutting grooves into the support plane and into the framework which run parallel to one another towards the edges of the support plane. The ends of the coupling elements click into the grooves thus joining the parts to one another.

Yet another advantage of this invention is the possibility of being able to make with the same components, either a traditional frame or a frameless clip frame, depending on whether the framework is used or not, because one can apply the type of clips used for frameless clip frames to the grooves in the support plane. As a result the use of these blocking components on the type of traditional frames illustrated in this invention increases ulteriorly the strength of the frame in as much as these components serve to support the transparent plane.

The following is a detailed description of the illutrative embodiments thereof.

DETAILED DESCRIPTION OF THE PREFERRED EMBODIMENTS

Figure 1:
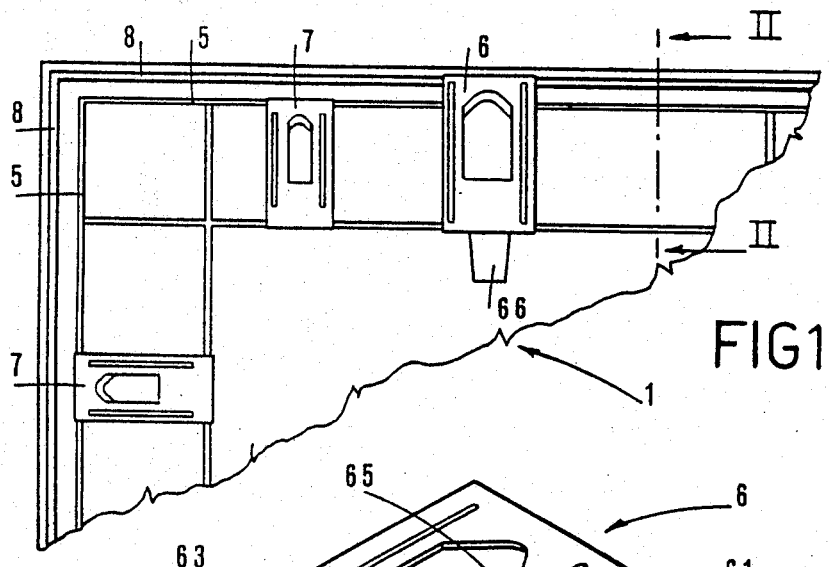
FIG. 1 is a partial view of the rear corner of the frame (the side which is not on display) in accordance with one form of the present invention.
Figure 2:
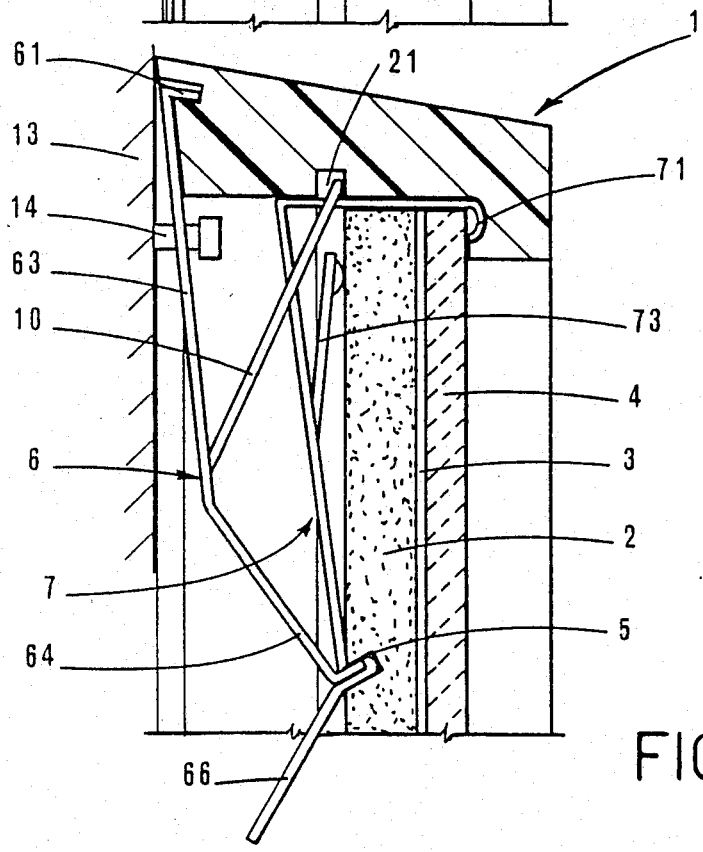
FIG. 2 is a sectional view of the top part of the frame shown in FIG. 1 taken along lines 2—2 of FIG. 1.

With reference to FIGS. 1 and 2, a traditional frame consists of a polygonal framework 1 which goes around the edge, a rigid plane 2 for supporting the image 3 and a transparent plane 4 for protecting the image 3.

At the back the framework 1 has a ledge 12 onto which is lodged the transparent plane 4, then the image 3 and then the supporting plane 2.

In conformity with the present invention (see FIG. 1) the support plane 2 is joined to the framework 1 by means of coupling elements 6 which are the components which hold the entire frame together.

The support plane 2 has at the back, or on the side which is not displayed, parallel to its edges, a series of grooves 5 (see FIG. 1), each one being parallel to one side of the support plane 2, into which is placed the piece marked 62 of the coupling elements 6, the piece of which is marked 61, hooks onto the framework 1.

Figure 3:
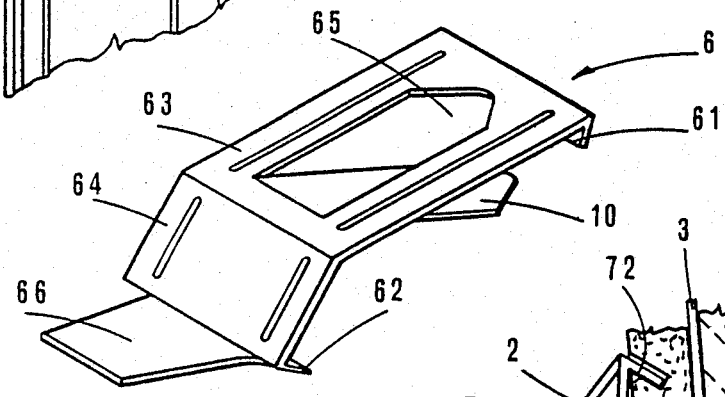
FIG. 3 shows, in perspective, a coupling element for joining the support plane to the framework, in accordance with the present invention.

The middle section of each coupling element 6 (see FIGS. 2, 3 and 4) is divided into a long section 63, which runs parallel to the support plane 2, and a short section 64 which besides helping to bring piece 63 parallel to the support plane, helps the coupling element 6 lengthen itself so that its end 62 fits into one of the grooves 5 of the support plane 2.

In the long section 63 of every coupling element 6 there is a springly or resilient element 10 which serves to press the transparent plane 4 and the support plane 2 against the bottom of the ledge 12 of the framework 1. To improve and assure the assembly of the frame framework 1 has, on the side of the frame which is at a right-angle to the ledge 12, a groove 21 into which is slotted the free end of the resilient element 10.

To improve the function of the coupling element 6, above all when disengaging it from the support plane 2, a tongue 66 has been attached to part 62.

Figure 4:
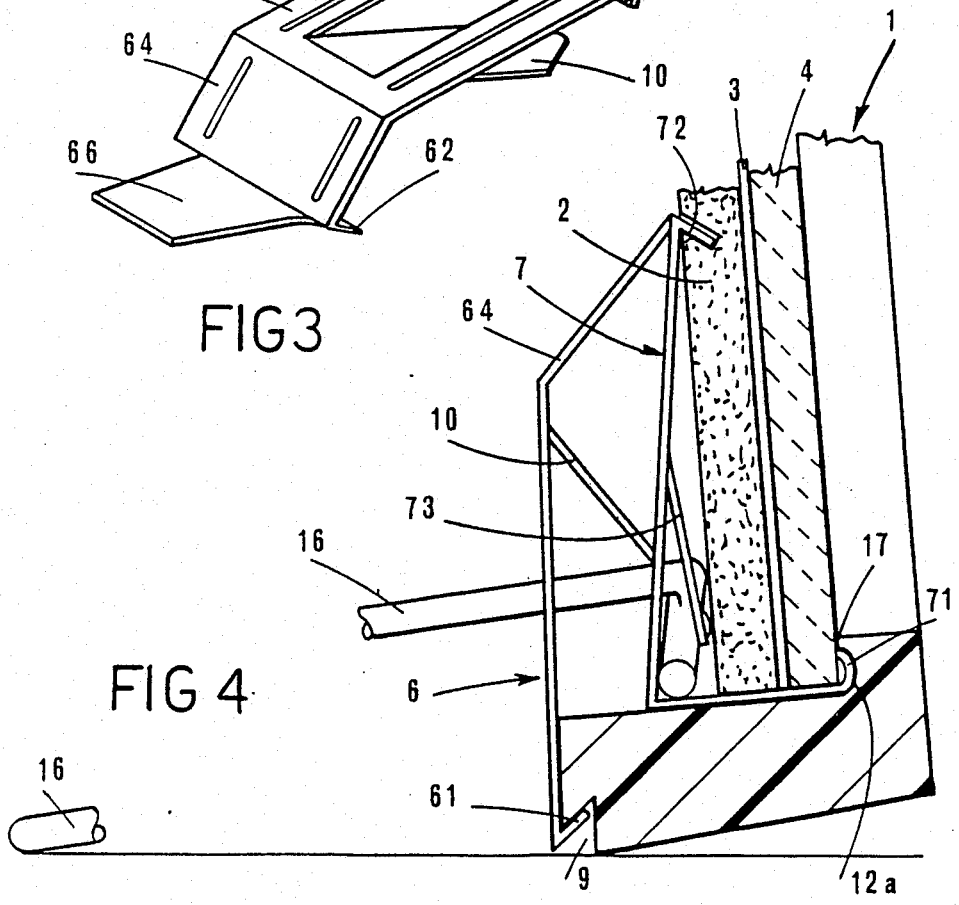
FIG. 4 shows a partial lateral section of the picture frame, in accordance with the present invention, resting on a table-top.

As one can imagine, and as can be seen in FIGS. 2 and 4, the grooves 5 are at an angle to the support plane 2, to be precise towards the center of the latter in order to prevent the coupling elements 6 from coming away from the support plane 2.

The end 72 of the blocking element 7 (see FIG. 2) can be inserted into the grooves 5 of the support plane 2, of which the other end 71 encompasses the perimeter of the support plane 2 and transparent plane 4 until it touches the side of the latter which is displayed. The length of the extremity 71 is such that it remains completely covered by the border 17 produced by the realization of the ledge 12 in the framework 1 and furthermore the latter has a dip 12*a* for accommodating the said end 71.

In the central section of each blocking element 7, there is a springy or resilient element 73, similar to the resilient element 10 of the coupling elements 6, which serve to press the frameless clip frame which has been made, against the end 71 of the said blocking element 7.

The resilient element 73 and 10 of the blocking elements 7 and respectively the coupling elements 6 are made by partially shearing with a punch which makes respectively in the blocking elements 7 and coupling elements 6, a hole (indicated in FIG. 3 as hole 65 formed in the coupling element 6), which is triangular in shape towards the end of the respective element when mounted on the frame in the direction of the framework 1. This triangular end of the hole 65 is used for hanging the coupling elements (or blocking elements 7) to one or more nails 14 fixed to the wall 13.

As illustrated in FIGS. 1 and 2, on the side of framework 1 hidden from the eye there is a perimetral groove 8 into which is inserted the end 61 of the coupling element 6 in order to realize the frame according to this invention.

As illustrated in FIG. 4, an alternative embodiment of the present invention allows that, in correspondence to the external edge and where it cannot be seen, in the framework 1 there is a groove 9 into which is placed the end 61 of the coupling element 6.

Figure 5:
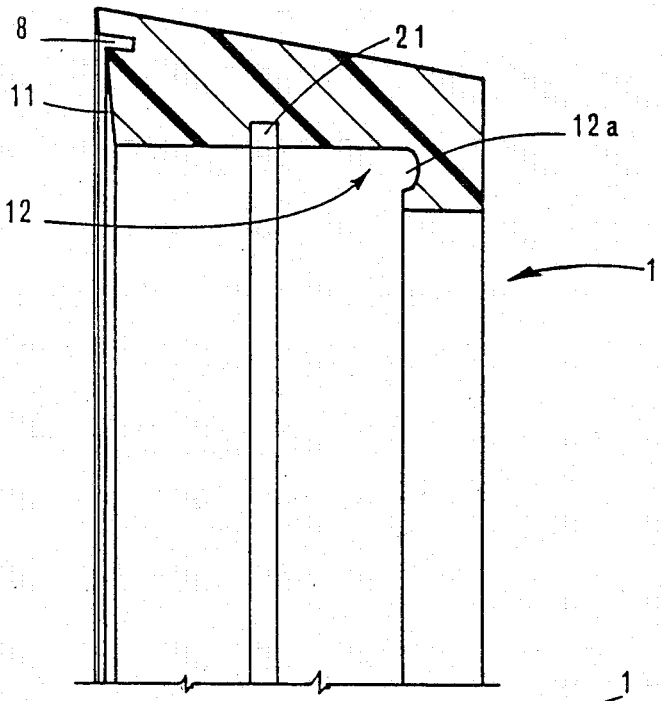
FIG. 5 shows, in section, a variation in the profile of the framework of the frame of the present invention.

In order that the coupling elements 6 do not come out of the cut in the framework 1 (see FIG. 5) the plane 11 on the inside of the framework 1 can be at an angle with a reduction in the thickness from the outside towards the inside of the framework 1 and at such an angle that the coupling elements do not come out of the cut in the framework 1.

In order to mount the frame according to the present invention, it is sufficient to insert the transparent plane 4, the image 3 and the support plane 2, preferably all linked together in the manner already noted as a frameless clip frame, by means of the blocking elements 7, onto the ledge 12 of the framework 1 and apply a sufficient number of the coupling elements 6 in the grooves 5 of the support plane 2 and in the grooves 8 (or 9) of the framework 1.

The frame when made in this manner can be hung on a wall 13 using the coupling elements 6 for hooking the frame on to one or more nails 14. In this case the component which acts as the load-bearing element, is the support plane 2.

Alternatively, the frame can be rested on a table top 15 and held in an almost vertical position by inserting the ends of a foot 16 as shown, between the support plane 2 and two of the lower blocking elements 2.

The invention thus conceived can have many variations and changes made to it, all of which are covered by the ambit of the inventive concept. Furthermore, all of the details can be substituted by technically equivalent elements.

What is claimed is:

1. A picture frame arrangement comprising a framework receiving a substantially rigid, flat support element and a transparent element, a picture being interposed between said flat support element and said transparent element, the support and the transparent elements and the picture defining together a picture block, said picture block being held together within an interior said framework by at least one locking member, said at least one locking member having a base portion, a lip and a side wall extending from the base portion, said picture block is supported by the base portion and situated between the side wall and the lip of said at least one locking member, a free end of the side wall engages with a first groove located within the support element, a first spring element extends from the side wall and presses the picture block within said locking member against the lip, said framework having the picture block attached to a supporting surface through at least one coupling element, said at least one coupling element comprising a first elongated base portion, a second base portion exposed at an angle to said first elongated base portion, a second spring element extending from said first elongated base portion, a free end of said second base portion engaging with said first groove of said support element and a free end of said first base portion engaging a second groove situated within a wall of the framework, an opening within the first elongated base receiving a hanging element, whereby in the assembled condition of the arrangement said second spring element presses against the side wall of said at least one locking member keeping the entire arrangement together.

2. A picture frame arrangement according to claim 1, wherein said base of said at least one locking member closely engages with an inside surface of a wall of the framework.

3. A picture frame arrangement according to claim 2, wherein an exterior of the lip engages with an acr-shaped portion of the inside surface of the wall of the framework.

4. A picture frame arrangement according to claim 1, wherein a free end of the side wall has a hook type configuration engaging said first groove.

5. A picture frame arrangement according to claim 4, wherein said at least one locking member is made of a resilient material and said picture block firmly connected to the side wall by the hook type free end is pressed by said first spring element against the flixble lip.

6. A picture frame arrangement according to claim 1, wherein said first and second grooves extend along the entire perimeter of the picture frame arrangement.

7. A picture frame arrangement according to claim 1, wherein said base of said at least one coupling element has a releasing spring means extending substantially outwardly from said free end of said second base for releasing said at least one coupling element from engagement with the support element.

8. A picture frame arrangement according to claim 7, wherein said releasing spring means is an elongated member which is an extension of said free end of the second base.

9. A picture frame arrangement according to claim 1, wherein said free ends of said first and second of base portions have a hook type configuration.

10. A picture frame arrangement according to claim 1, wherein a back face of sides of said framework is inclined and have reduction of a thickness of the sides of the framework towards a center thereof allowing said coupling element to remain within said framework.

11. A picture frame arrangement according to claim 1, wherein lock type configuration of the free end of said first base portion closely engages with said second groove.

* * * * *